United States Patent [19]

Nagasawa et al.

[11] 4,360,783

[45] Nov. 23, 1982

[54] LAMP POWER REGULATOR

[75] Inventors: Kiyoto Nagasawa; Yuzi Narumi, both of Tokyo, Japan

[73] Assignee: Ricoh Company, Ltd., Tokyo, Japan

[21] Appl. No.: 210,078

[22] Filed: Nov. 24, 1980

[30] Foreign Application Priority Data

Dec. 3, 1979 [JP] Japan ..... 54-156656

[51] Int. Cl.[3] ..... H05B 39/08; G06G 7/20

[52] U.S. Cl. ..... 328/144; 307/304; 315/199; 315/307; 323/243; 355/69

[58] Field of Search ..... 323/242, 243, 246; 307/304; 328/144; 315/194, 199, 291, 307; 355/69

[56] References Cited

U.S. PATENT DOCUMENTS

| | | | |
|---|---|---|---|
| 3,348,155 | 10/1967 | Recklinghausen | 328/144 X |
| 3,517,178 | 6/1970 | Herndon | 307/304 X |
| 4,047,235 | 9/1977 | Davis | 323/243 X |
| 4,245,183 | 1/1981 | Glennon | 328/144 X |

*Primary Examiner*—Eugene R. LaRoche
*Attorney, Agent, or Firm*—David G. Alexander

[57] ABSTRACT

An effective voltage across a load such a lamp (L) is squared by means of a field effect transistor (FET) to produce an output voltage which varies in proportion to the power through the load (L). A trigger phase of a thyristor (TRC) connected between an A.C. power source (PS) and the load (L) is automatically varied in such a manner that the output voltage and thereby the power through the lamp (L) are regulated to a desired value.

5 Claims, 4 Drawing Figures

LAMP POWER REGULATOR

BACKGROUND OF THE INVENTION

The present invention relates to an improved regulator for automatically regulating the power applied to a load such as a lamp to a predetermined value. The regulator is especially suited, but not limited to application for regulating the power applied to a document illumination lamp in an electrostatic copying machine.

Variations in the power applied to such a lamp causes variation of the luminous intensity of the lamp and thereby the density of a copy produced by the electrostatic copying machine. Short term variations caused by power supply fluctuations and the like cause localized uneven copy density in a single copy. Many attempts to provide precise regulation of lamp power have been made in an attempt to eliminate this obviously undesirable phenomenon, but none of these efforts have heretofore proven completely successful.

SUMMARY OF THE INVENTION

An apparatus embodying the present invention for maintaining an electric power through a load at a predetermined power value comprises a power source for applying an electric voltage signal to the load, sensor means for sensing an effective voltage across the load, squaring means for producing an output voltage which varies substantially in proportion to a square of said effective voltage and regulator means for varying said electric voltage signal applied to the load by the power source in such a manner that said output voltage is regulated to a predetermined voltage value which corresponds to said predetermined power value.

In accordance with the present invention, an effective voltage across a load such as a lamp is squared by means of a field effect transistor to produce an output voltage which varies in proportion to the power through the load. A trigger phase of a thyristor connected between an A.C. power source and the load is automatically varied in such a manner that the output voltage and thereby the power through the lamp are regulated to a desired value.

It is another object of the present invention to provide a generally improved lamp power regulator.

Other objects, together with the foregoing, are attained in the embodiments described in the following description and illustrated in the accompanying drawing.

DESCRIPTION OF THE PREFERRED EMBODIMENTS

While the lamp power regulator of the present invention is susceptible of numerous physical embodiments, depending upon the environment and requirements of use, substantial numbers of the herein shown and described embodiments have been made, tested and used, and all have performed in an eminently satisfactory manner.

Figure 1:
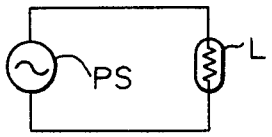
FIGS. 1 and 2 are diagrams explanatory of the present invention.

As well known in the art, the light output of a tungsten lamp depends a great deal on the voltage. As shown in FIG. 1, where a tungsten lamp L is connected with an AC power source and turned on, the power P at the lamp L may be expressed as:

$$P=E^2/R$$

where E denotes the voltage (effective or RMS value) of the AC power source PS and R the resistance of the lamp L. This equation shows that the power P varies in proportion to the square of the source voltage E. In practice, the exponent is 2 or less because the resistance R of the lamp L has a positive temperature coefficient. However, a fluctuation in the power P of the lamp causes the color temperature and, therefore, the spectral distribution of the lamp to vary so that the exponent mentioned above may increase beyond 2 depending on the wavelength range concerned. It will thus be understood that, with a lamp energizing system of the type shown in FIG. 1 applied to a copying machine for instance, a change in the source voltage by ±10% is reflected by a change in the luminous flux of the lamp by about ±30% which will result various unfavorable phenomena such as irregularity in the density of reproduced images.

With this in view, strict stability of light output of a lamp as will be required in some applications is usually attained by connecting a lamp regulator between a power source and a lamp so as to hold the lamp voltage at a constant level. Concerning copying machines or the like, there may be established a standard which requires the lamp voltage to maintain its fluctuation within ±5% or less against a ±15% fluctuation of the source voltage.

Generally, lamp regulators employ a phase control system based on a TRIAC or the like and take the form of any one of three different devices: (1) a device which detects the mean value of the lamp voltage (or current) and keeps this mean value constant; (2) a device which utilizing the non-linearity of diodes or the like detects the approximate effective value of the lamp voltage and maintains this constant; and (3) a device which detects the effective value of the lamp voltage or current and holds this constant.

The light output of a lamp is dependent on the effective values of voltage and current thereof. In other words, the light output cannot remain constant unless the voltage and current of the lamp are kept constant in effective value. In a sinusoidal wave, the effective value and mean value are expressed as:

$$\frac{\text{mean value}}{\text{effective value}} = \frac{2\sqrt{2}}{\pi}$$

This ratio has a constant value as long as the waveform remains the same and, hence, to keep the mean value constant is to keep the effective value constant.

The lamp regulator mentioned above, however, fails to hold a constant relation between the effective value and mean value and permits it to vary in accordance with the waveform of lamp voltage and current since, due to the use of a phase control system, the waveform undergoes significant distortions relative to a sinusoidal wave. Accordingly, the devices (1) and (2) cannot attain the necessary precision. The device (1) which detects the mean value of the lamp voltage or current causes the light output of a lamp to fluctuate ±10% or more when the source voltage varies ±10%. The device (2) may achieve in an approximate sense a precision equivalent to that obtainable with an effective value detecting system within a range where the phase fluctuation is relatively small, but it fails to ensure a sufficient precision against a wide range of phase fluctuation. Additionally, the device (2) needs a disproportionately intricate circuit arrangement. Based on the effective value detecting system, the device (3) may employ one of three known systems: (i) a system which uses a lamp; (ii) a system which utilizes heat generation at a lamp; and (iii) a system which determines effective values by calculation. Of these systems, the system (i) is slow in response and needs maintenance in connection with failure of the lamp and contamination thereof; the system (ii) is also slow in response; and the system (iii) needs an intricate construction which adds to the cost although the operation may be accurate.

It is an object of the present invention to provide a load power regulating system which stabilizes power with high accuracy despite a relatively simple construction using the non-linearity of a field effect transistor.

Figure 2:
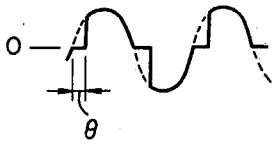
Figure 4:
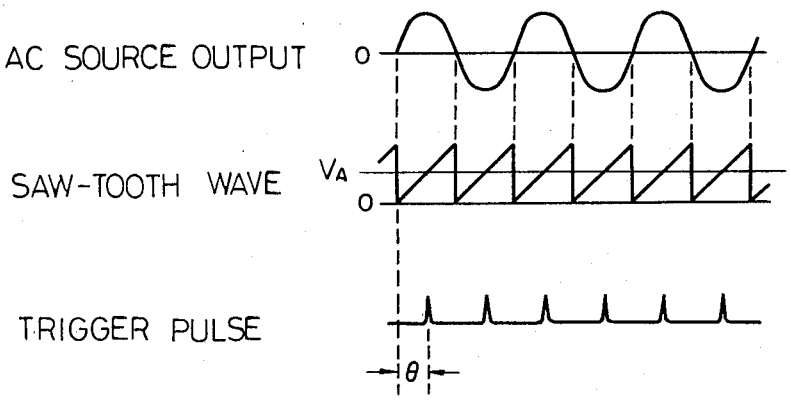
FIG. 4 shows in timing chart form the operation of the apparatus of FIG. 3.

The present invention will be described hereinafter with reference to FIGS. 2–4.

A preferred embodiment of the invention which will be discussed is of a voltage detection type based on a phase control system. FIG. 2 shows the waveform of a current and voltage of a tungsten lamp. The system of the invention holds the lamp voltage constant by varying the cut-off phase angle $\theta$ indicated in FIG. 2. Concerning the waveform of FIG. 2, the ratio r of the mean value to the effective value depends on the cut-off phase angle $\theta$ and is expressed as:

$$r = \frac{\text{mean value}}{\text{effective value}} = \frac{\sqrt{2}}{\pi} \cdot \frac{1 + \cos\theta}{\sqrt{1 - \frac{\theta}{\pi} + \frac{1}{2\pi}\sin 2\theta}}$$

Thus, the ratio r increases with the phase angle $\theta$. The lamp power P as already stated is expressed as:

$$P = E^2/R$$

However, the lamp power P can be replaced by the mean value $E_A$ of the lamp voltage as:

$$E = E_A/r$$

Hence, the lamp power P depends on the ratio r as represented by:

$$P = E^2A/r^2R$$

This means that the lamp power P depends on the phase angle $\theta$. Accordingly, even if the mean lamp voltage $E_A$ is kept constant, the lamp power P will fail to hold a constant level when the phase angle $\theta$ varies. To maintain the lamp power P (i.e. light output) constant against a wide range of fluctuation of the source voltage, the cut-off phase angle $\theta$ must be varied over a large range and, in this case, the system detecting the mean value $E_A$ cannot offer the necessary stability. Yet, as the equations show, the lamp power P can be kept constant regardless of the phase angle $\theta$ (or ratio r) by maintaining the effective value E constant.

The embodiment of the present invention is designed to detect the effective lamp voltage E by the use of a field effect transistor so that accurate stabilization of light output is achieved while ensuring sufficient response and reliability.

Figure 3:
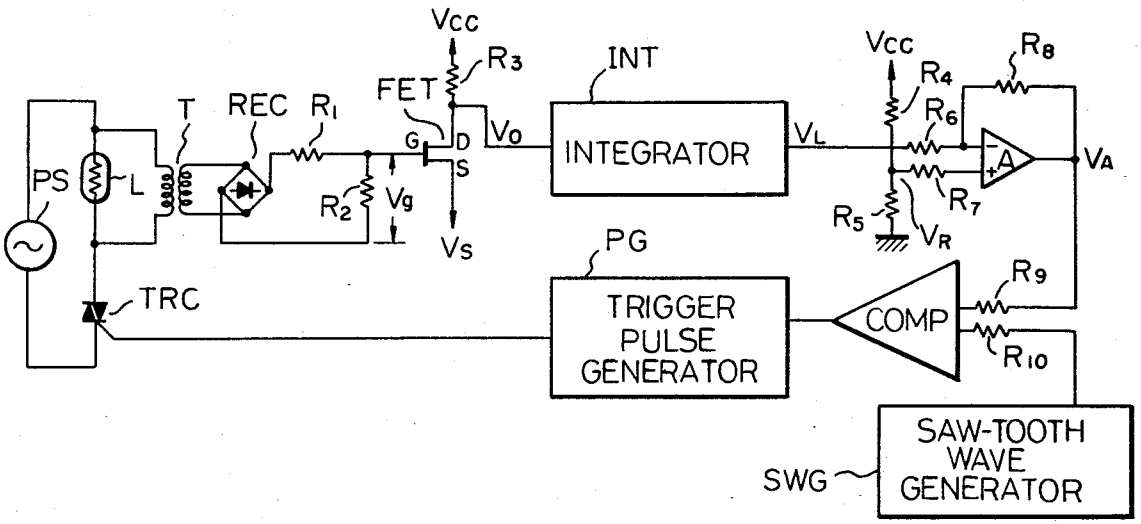
FIG. 3 is a block diagram showing a preferred embodiment of the present invention.

FIG. 3 shows one embodiment of the present invention.

The voltage of a tungsten lamp L is detected by a lamp voltage detecting transformer T, full-wave rectified by a rectifier circuit REC and then divided by resistors $R_1$ and $R_2$. The divided voltage is applied to a gate G of a field effect transistor FET. The transistor FET receives at its sources S a bias voltage $V_s$ which makes the drain current $I_D$ substantially zero when the gate voltage $V_G$ is zero and, at its drain D, a constant DC voltage $V_{cc}$ through a resistor $R_3$. The resistors $R_1$ and $R_2$ have such resistances such that they determine the gate voltage $V_G$ in such a manner as to prevent the peak value of the gate voltage $V_G$ from increasing beyond the voltage $V_{GS}$ between the gate and source. It is known that the drain current $I_D$ can be approximated as shown below within a certain range:

$$I_D = I_{DSS}(1 - V_{GS}/V_P)^2$$

where $V_P$ indicates the cut-off voltage of the field effect transistor FET and $I_{DSS}$ the drain current $I_D$ which will appear when the voltage $V_{GS}$ is zero.

Since there hold equations $-V_p = V_s$ and $V_{GS} = V_g - V_s$, the drain current $I_D$ can be expressed as:

$$I_D = (I_{DSS}/V_p^2) \cdot V_g^2$$

Thus, the out voltage $V_0$ of the field effect transistor FET is obtained as:

$$V_0 = V_{cc} - I_D \cdot R_3 = V_{cc} - KV_g^2R_3$$

where $K = I_{DSS}/V_g^2$.

The output voltage $V_0$ therefore contains a component which is proportional to the square of the input voltage $V_g$ of the field effect transistor. This component, when integrated (smoothed) by an integrator INT, will provide a DC voltage $V_L$ proportional to the square of the input voltage $V_g$. This voltage $V_L$ can be considered as reflecting the effective value of the lamp voltage. A circuit made up of an amplifier A and resistors $R_6$–$R_8$ compares the DC voltage $V_L$ with a reference voltage $V_R$ determined by resistors $R_4$ and $R_5$ and then produces a DC voltage corresponding to the difference. This DC output voltage is coupled through resistors $R_9$ and $R_{10}$ to a comparator COMP together with a sawtooth wave generated by a sawtooth wave generator SWG. In response to an output of the comparator COMP, a trigger pulse generator PG produces a trigger pulse at the instant the output voltage of the amplifier A drops below the sawtooth wave. The trigger pulse turns on a thyristor or TRIAC TRC so that the cut off phase of the AC power from the AC power source PS to the lamp L is controlled. As viewed in FIG. 4, the sawtooth wave is maintained in synchronous relation with the output of the AC power source PS and the trigger pulse generating phase $\theta$ depends on the magnitude of the output voltage of the amplifier A.

Let it now be assumed that the voltage at the lamp L has increased for one reason or another. The input voltage $V_g$ of the field effect transistor FET increases in proportion thereto whereby the output voltage $V_0$ thereof decreases by a proportion equal to the increase in the effective value of the input voltage $V_g$. This also causes the output $V_L$ of the integrator INT to decrease. The amplifier A compares the voltage $V_L$ with the reference voltage $V_R$ and its output voltage increases in correspondence with the difference. The amplifier A output is compared by the comparator COMP with the output of the sawtooth wave generator SWG. Eventually, the phase of the trigger pulses appearing from the trigger pulse generator PG is shifted in a direction to increase the phase $\theta$ shown in FIG. 4 so that the voltage applied to the lamp L is lowered. Conversely, when the lamp voltage has been lowered, the cut-off phase angle $\theta$ of the TRIAC TRC decreases to in turn increase the lamp voltage. It will thus be seen that the illustrated system is so operated as to equalize the voltage $V_L$ with the reference voltage $V_R$. Since the voltage $V_L$ is proportional to the squared mean value of the voltage $V_g$, that is, the square of the effective lamp voltage, the effective value of the lamp voltage is always kept at a constant level proportional to the desired power value. Therefore, the lamp power also remains constant regardless of the waveform maintaining the intensity of light emitted from the lamp L constant. An additional advantage is that a relatively simple circuit arrangement suffices because the effective value is detected by a single element which comprises a field effect transistor. Furthermore, the illustrated system can bifunction as a dimmer since the lamp voltage can be varied by varying the reference voltage $V_R$.

While the present invention has been shown and described in connection with a system which detects the effective lamp voltage value (squared mean value), it is also applicable to a system which detects the effective value or squared mean value of the lamp current. In such an alternative application, processing similar to that performed as described will be carried out after transforming the lamp current into a voltage through resistors or the like. It will be noted that the present invention is effective to maintain constant power of any other load as well as the power of a lamp.

It will be appreciated from the foregoing that a load current stabilizing system according to the present invention is excellent in response, reliability and accuracy and achievable with a relatively simple circuit arrangement.

Various modifications will become possible for those skilled in the art after receiving the teachings of the present disclosure without departing from the scope thereof.

What is claimed is:

1. An apparatus for maintaining an electric power through a load at a predetermined power value, comprising a power source for applying an electric voltage signal to the load, sensor means for sensing an effective voltage across the load, squaring means for producing an output voltage which varies substantially in proportion to a square of said effective voltage and regulator means for varying said electric voltage signal applied to the load by the power source in such a manner that said output voltage is regulated to a predetermined voltage value which corresponds to said predetermined power value;

the squaring means comprising a field effect transistor; and integrator means connected between the squaring means and the regulator means for producing an output signal corresponding to a squared mean value of said output voltage of the squaring means.

2. An apparatus as in claim 1, in which said electric voltage signal is an A.C. voltage, the regulator means comprising switch means.

3. An apparatus as in claim 2, in which the switch means comprises a thyristor.

4. An apparatus as in claim 3, in which the regulator means is constructed to vary said electric voltage signal by varying a trigger phase of the thyristor.

5. An apparatus as in claim 2, in which the sensor means comprises rectifier means.

* * * * *